US009463624B2

(12) United States Patent
Seki et al.

(10) Patent No.: US 9,463,624 B2
(45) Date of Patent: Oct. 11, 2016

(54) LIQUID DISCHARGING HEAD AND METHOD FOR PRODUCING THE SAME

(71) Applicant: CANON KABUSHIKI KAISHA, Tokyo (JP)

(72) Inventors: Sayaka Seki, Tokyo (JP); Naoko Tsujiuchi, Kawasaki (JP); Satoshi Kimura, Kawasaki (JP); Kiyomitsu Kudo, Machida (JP); Kazuhiro Idogawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/723,219

(22) Filed: May 27, 2015

(65) Prior Publication Data

US 2015/0343777 A1 Dec. 3, 2015

(30) Foreign Application Priority Data

May 30, 2014 (JP) ..... 2014-112185

(51) Int. Cl.
*B41J 2/14* (2006.01)
*B41J 2/16* (2006.01)

(52) U.S. Cl.
CPC ..... *B41J 2/1433* (2013.01); *B41J 2/14024* (2013.01); *B41J 2/14072* (2013.01); *B41J 2/162* (2013.01); *B41J 2/1603* (2013.01); *B41J 2/1623* (2013.01); *B41J 2002/14491* (2013.01)

(58) Field of Classification Search
CPC B41J 2/14024; B41J 2/14072; B41J 2/1623; B41J 2002/14491; B41J 2202/20
USPC ..... 347/50, 58, 59; 156/314
See application file for complete search history.

(56) References Cited

U.S. PATENT DOCUMENTS

2004/0032468 A1* 2/2004 Killmeier ..... B41J 2/1753 347/85
2009/0122100 A1* 5/2009 Hida ..... B41J 2/14201 347/20
2013/0187991 A1* 7/2013 Watanabe ..... B41J 2/14274 347/71

FOREIGN PATENT DOCUMENTS

JP 2002-079675 A 3/2002

* cited by examiner

*Primary Examiner* — Manish S Shah
*Assistant Examiner* — Roger W Pisha, II
(74) *Attorney, Agent, or Firm* — Canon USA, Inc. I.P. Division

(57) ABSTRACT

A liquid discharging head includes a recording element substrate configured to discharge a liquid; an electric wiring substrate that is provided with a lead terminal that is connected to the recording element substrate; and a supporting member to which the electric wiring substrate is bonded. The electric wiring substrate is bonded to the supporting member with two or more types of adhesives including at least a first adhesive and a second adhesive whose volume resistivity is higher than that of the first adhesive, a bond strength of the first adhesive is higher than a bond strength of the second adhesive, and, at the supporting member, the second adhesive is applied such that the second adhesive is provided closer to the lead terminal than the first adhesive.

17 Claims, 5 Drawing Sheets

LIQUID DISCHARGING HEAD AND METHOD FOR PRODUCING THE SAME

BACKGROUND OF THE INVENTION

1. Field of the Invention

The present invention relates to a liquid discharging head that discharges a liquid, such as ink, and to a method for producing the same.

2. Description of the Related Art

Hitherto, a liquid discharging head that is used in a liquid discharging device and that includes a recording element substrate, a supporting member to which the recording element substrate is bonded, and an electric wiring substrate provided with lead terminals that are connected to connection terminals at the recording element substrate has been available. In order to prevent faulty connection, such as wire breakage, caused by outside force or corrosion by a liquid, connecting portions between the connection terminals of the recording element substrate and the lead terminals of the electric wiring substrate are covered and sealed with a sealing material after connecting each substrate to the supporting member with an adhesive. As a method for sealing the connecting portions, a method for applying a sealing material to a top portion of each lead terminal and causing the sealing material to enter from portions between the lead terminals that are adjacent to each other, to fill the portions between the lead terminals that are adjacent to each other up to lower portions of the lead terminals is known. However, in this sealing method, it is difficult to fill spaces at the lower portions of the lead terminals with the sealing material in one applying operation. This may cause improper sealing at the lower portions of the lead terminals due to, for example, cavities and air bubbles.

As a measure against such improper sealing, Japanese Patent Laid-Open No. 2002-079675 (Japanese Patent Laid-Open No. 2002-079675) discloses a structure in which a sealing material receiver is provided at the lower portions of the lead terminals. In this structure, the sealing material receiver receives the sealing material moving towards the lower portions of the lead terminals from gaps between the plurality of lead terminals that are adjacent to each other. This increases the coverability by the sealing material near the lead terminals. Therefore, it is possible to reduce improper sealing and to prevent faulty connection occurring when the lead terminals are corroded by ink.

According to the technology discussed in Japanese Patent Laid-Open No. 2002-079675, faulty connection caused by corrosion of the lead terminals by ink is prevented by increasing the coverability of the vicinity of the lead terminals by the sealing material. However, in this technology, corrosion of the lead terminals caused by contact with an adhesive when, before sealing the lead terminals with the sealing material, the electric wiring substrate provided with the lead terminals is bonded to the supporting member with the adhesive is not considered. In order to firmly bond the electric wiring substrate to the supporting member with the adhesive, it is necessary to apply the adhesive to a certain thickness. In particular, when the supporting member is formed of a resin material and has a low flatness accuracy, it is necessary to apply the adhesive to a greater thickness. In this case, the adhesive that has been pressed down to the electric wiring substrate during the bonding step may protrude from the supporting member and contact the lead terminals.

In general, as an adhesive for bonding the supporting member and the electric wiring substrate to each other, a photo-curable adhesive whose principal component is epoxy resin and that is electrically conductive is used. Therefore, when the adhesive protruding from the supporting member contacts the lead terminals, the lead terminals are electrically connected with each other through the adhesive, as a result of which the lead wires may become corroded. Therefore, instead of using a photo-curable adhesive, a thermosetting adhesive having a volume resistivity that is higher than that of a photo-curable adhesive may be used. However, the bond strength of a thermosetting adhesive is lower than that of a photo-curable adhesive. Therefore, when a thermosetting adhesive is used, the electric wiring substrate and the supporting member may not be sufficiently bonded to each other.

SUMMARY OF THE INVENTION

According to a first aspect of the present invention, there is provided a liquid discharging head including a recording element substrate configured to discharge a liquid; an electric wiring substrate that is provided with a lead terminal that is connected to the recording element substrate; and a supporting member to which the electric wiring substrate is bonded. The electric wiring substrate is bonded to the supporting member with two or more types of adhesives including at least a first adhesive and a second adhesive whose volume resistivity is higher than that of the first adhesive, a bond strength of the first adhesive is higher than a bond strength of the second adhesive, and, at the supporting member, the second adhesive is applied such that the second adhesive is provided closer to the lead terminal than the first adhesive.

According to a second aspect of the present invention, there is provided a method for producing a liquid discharging head including a recording element substrate configured to discharge a liquid, an electric wiring substrate that is provided with a lead terminal that is connected to the recording element substrate, and a supporting member to which the electric wiring substrate is bonded. The method includes the steps of applying two or more types of adhesives including at least a first adhesive and a second adhesive whose volume resistivity is higher than that of the first adhesive, and bonding the electric wiring substrate to the supporting member with the two or more types of adhesives. In the applying step, after the first adhesive whose bond strength is higher than that of the second adhesive has been applied to the supporting member, at the supporting member, the second adhesive is applied such that the second adhesive is provided closer to the lead terminal than the first adhesive.

Further features of the present invention will become apparent from the following description of exemplary embodiments with reference to the attached drawings.

DESCRIPTION OF THE EMBODIMENTS

First Embodiment

Figure 1A:
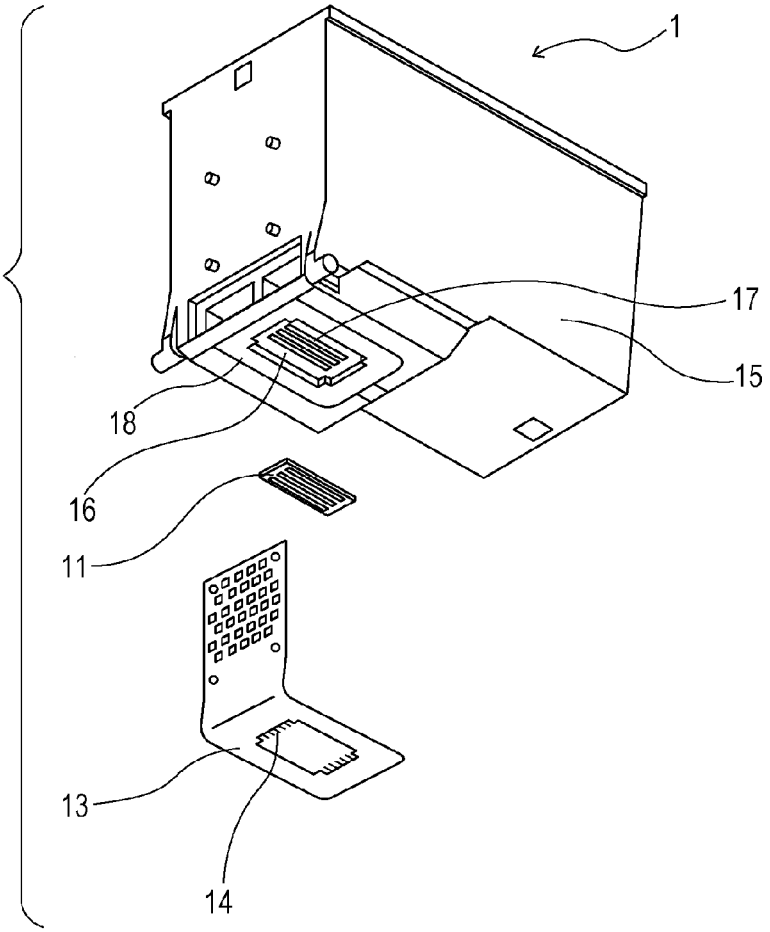
FIGS. 1A and 1B are each a perspective view of a liquid discharging head according to a first embodiment of the present invention.
Figure 1B:
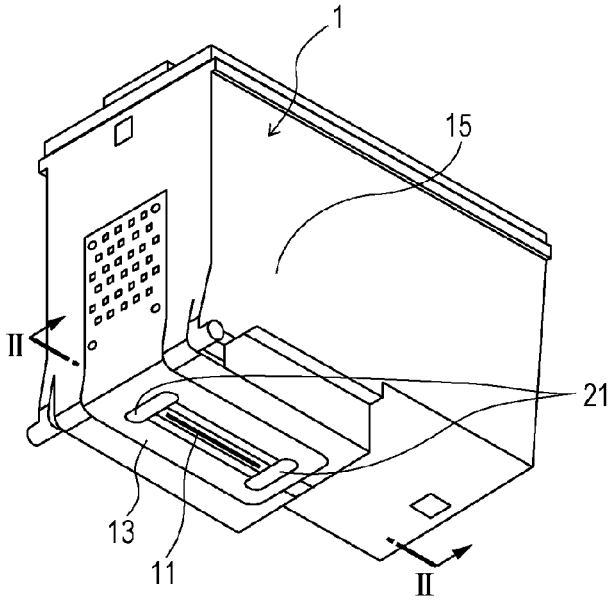

FIGS. 1A and 1B are each a perspective view of a liquid discharging head 1 according to a first embodiment of the present invention. FIG. 1A is an exploded perspective view of the liquid discharging head 1 according to the first embodiment. FIG. 1B is a perspective view in which each portion of the liquid discharging head 1 illustrated in FIG. 1A is assembled. As illustrated in FIGS. 1A and 1B, the liquid discharging head 1 according to the first embodiment includes a recording element substrate 11, an electric wiring substrate 13, and a supporting member 15.

The recording element substrate 11 includes a rectangular silicon substrate having a thickness on the order of from 0.6 mm to 0.8 mm. A plurality of energy-generating elements for discharging a liquid (hereunder may also be referred to as "ink") and electric wires that supply electric power to the energy-generating elements are formed on one surface of the silicon substrate by a film deposition technique. A plurality of ink flow paths (not shown) and a plurality of discharge openings (not shown), which are formed in correspondence with the plurality of energy-generating elements, are formed in the recording element substrate 11 by photolithography. Further, a plurality of connecting terminals 12 (see FIG. 3) are provided at two end portions of the recording element substrate 11 in a short-side direction. Ink supply paths (not shown) for supplying ink to the plurality of ink flow paths are formed in the other surface (back surface) of the recording element substrate 11. In the first embodiment, each energy-generating element is an electro-thermal converter that converts electric energy into heat energy.

The electric wiring substrate 13 provided with a plurality of wires is provided with a plurality of lead terminals 14 that are electrically connected to the respective connection terminals 12 that are provided at the recording element substrate 11. Each lead terminal transmits a drive signal and drive power for discharging a liquid to each energy-generating element through each connecting terminal 12. As illustrated in FIG. 1B, each lead terminal 14 is sealed with a sealing material 21. As the sealing material 21, for example, a thermosetting sealing material containing epoxy resin as a principal component is used.

As illustrated in FIG. 1A, the supporting member 15 includes a recessed portion 16, a flow path 17 that is provided at a bottom portion defining the recessed portion 16, and a bonding surface 18 that surrounds an open end of the recessed portion 16. The recessed portion 16 and the flow path 17 are integrally formed. The recording element substrate 11 is secured to the bottom portion defining the recessed portion 16. The flow path 17 communicates with the recording element substrate 11. As a material of the supporting member 15, for example, a resin material or a ceramic material as typified by alumina ($Al_2O_3$) is used. In the first embodiment, the material of the supporting member 15 is synthetic resin such as polyphenylene ether (PPE) and polyphenylene sulfide (PPS). The electric wiring substrate 13 is bonded to the bonding surface 18.

Figure 2:
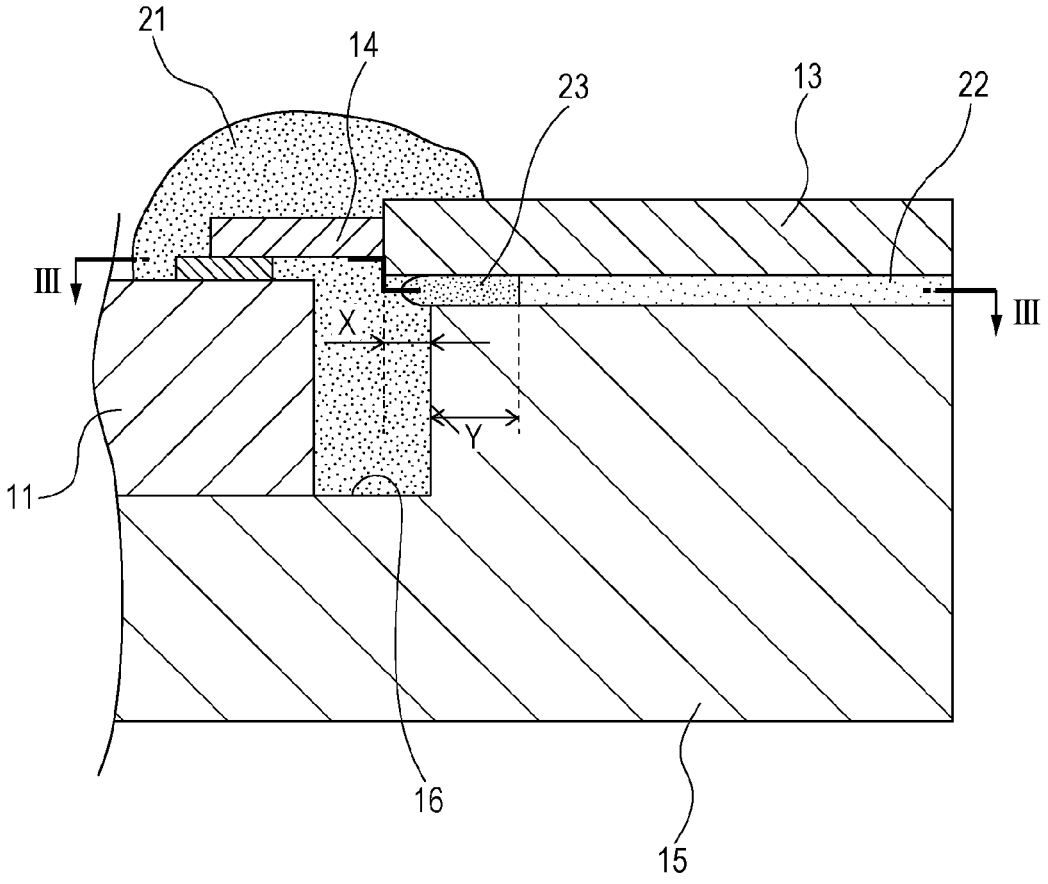
FIG. 2 illustrates a portion of a sectional view taken along line II-II in FIG. 1.
Figure 3:
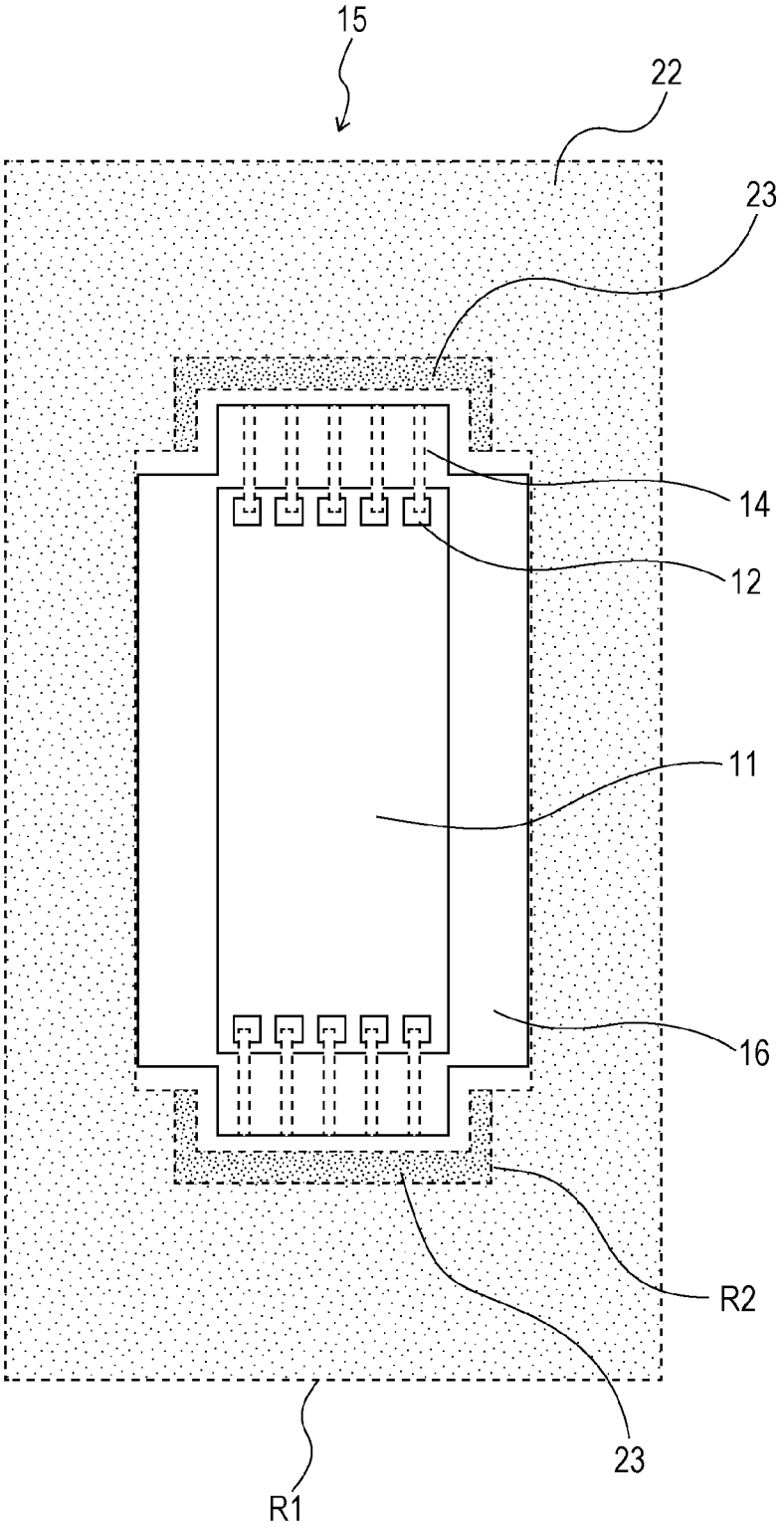
FIG. 3 is a sectional view taken along line III-III in FIG. 2.

FIG. 2 illustrates a portion of a sectional view taken along line II-II in FIG. 1B, and is a sectional view of the vicinity of the lead terminals 14. FIG. 3 is a sectional view of the vicinity of the recording element substrate 11 taken along line III-III in FIG. 2. The bonding of the supporting member 15 and the electric wiring substrate 13 to each other and the connection of the recording element substrate 11 and each lead terminal 14 with each other are hereunder described with reference to FIGS. 2 and 3.

As illustrated in FIGS. 2 and 3, the electric wiring substrate 13 is bonded to the supporting member 15 with a first adhesive 22 and a second adhesive 23. The first adhesive 22 is a photo-curable adhesive whose principal component is epoxy resin, and whose adhesive strength is higher than that of the second adhesive 23. In the first embodiment, the volume resistivity of the first adhesive 22 is 10 Ω·cm, and the viscosity of the first adhesive 22 is 3 Pas. The first adhesive 22 is applied to a first application region R1 (see FIG. 3) at the supporting member 15 by using a transfer pad (not shown).

The second adhesive 23 is a thermosetting adhesive whose principal component is bismaleimide. In the first embodiment, the volume resistivity of the second adhesive 23 is $10^{17}$ Ω·cm, and the viscosity of the second adhesive 23 is 7 Pas. That is, the volume resistivity and the viscosity of the second adhesive 23 are higher than those of the first adhesive 22. The second adhesive 23 is applied to a second application region R2 by using a dispenser (not shown). As illustrated in FIG. 3, the second application region R2 is closer to the lead terminals 14 than the first application region R1 to which the first adhesive 22 is applied.

Since the volume resistivity of the second adhesive 23 is higher than that of the first adhesive 22, even if the second adhesive 23 contacts the lead terminals 14, the probability with which the lead terminals become electrically connected to each other and corroded is low. However, it is desirable that the second adhesive 23 not contact the lead terminals 14. Therefore, in the first embodiment, a distance X (see FIG. 2) of approximately 0.3 mm is provided, to make it less likely for the second adhesive 23 that protrudes from the second application region R2 when the electric wiring substrate 13 is bonded to reach the lead terminals 14. As illustrated in FIG. 2, the distance X is a distance to an inner wall of the recessed portion 16 from an edge of an open portion of the electric wiring substrate 13 to which one end of each lead terminal 14 is connected. In this way, by placing the second adhesive 23 having a relatively high volume resistivity at the side of the lead terminals 14, it is possible for part of the second adhesive 23 to overflow from between the electric wiring substrate 13 and the supporting member 15 towards the lead terminals 14. This makes it possible to increase the adhesive strength at an end portion of the electric wiring substrate 13 and to reduce the occurrence of separation of the electric wiring substrate 13 and the supporting member 15 from each other.

In the first embodiment, by setting a width Y (see FIG. 2) of the second application region R2 to approximately 1 mm, the first adhesive 22 that is conductive is prevented from flowing towards the lead terminals 14 while the area of application of the second adhesive 23 having a low bond strength is minimized. In particular, in the first embodiment, as illustrated in FIG. 3, the second adhesive 23 is applied in a C shape so as to partly surround the lead terminals 14. This can prevent the flow of the first adhesive 22 from any direction.

A method for producing the liquid discharging head 1 according to the first embodiment is hereunder described.

First, the recording element substrate 11 is bonded to the bottom portion defining the recessed portion 16 of the supporting member 15 with an adhesive (not shown). This causes the flow path 17 of the supporting member 15 to communicate with the ink supply paths (not shown) of the recording element substrate 11. At this time, the adhesive is applied so that ink does not leak to the outside from the recessed portion 16.

Next, the transfer pad to which the first adhesive 22 has been applied is transferred (stamped) to the first application region R1 of the bonding surface 18 of the supporting member 15, to apply the first adhesive 22 to the first application region R1. Thereafter, the first adhesive 22 is preliminarily hardened by irradiating it with ultraviolet rays. Then, by discharging the second adhesive 23 from the dispenser towards the second application region R2, the second adhesive 23 is applied in a C shape.

Thereafter, the electric wiring substrate 13 is pushed against a portion where the lead terminals 14 are connectable to the connection terminals 12. Then, the lead terminals 14 are connected to the connection terminals 12 by inner lead bonding.

Finally, the gaps between the lead terminals and the recessed portion 16 are filled with sealing materials to seal connecting portions between the connection terminals 12 and the corresponding lead terminals 14.

As described above, in the liquid discharging head 1 according to the first embodiment, firm bonding between the electrical wiring substrate 13 and the supporting member 15 is ensured by using the first adhesive 22 whose bond strength is higher than that of the second adhesive 23. The second adhesive 23 whose volume resistivity is higher than that of the first adhesive 22 is applied to a region that is closer to the lead terminals 14 than the first adhesive 22. Therefore, when bonding the electric wiring substrate 13 to the supporting member 15, it is possible to prevent the first adhesive 22 and each lead terminal 14 from contacting each other. Even if the second adhesive 23 contacts the lead terminals 14, since the second adhesive 23 has a high volume resistivity (high insulation properties), the second adhesive 23 does not cause the lead terminals to be electrically connected with each other. As a result, it is possible to prevent corrosion of the lead terminals 14.

In the first embodiment, the viscosity of the second adhesive 23 is higher than that of the first adhesive 22. That is, it is less likely for the second adhesive 23 to flow than the first adhesive 22. Therefore, even if the electric wiring substrate 13 is pushed against the supporting member 15 for bonding it to the supporting member 15, it is less likely for the second adhesive 23 to protrude from the second application region R2. By this, it is less likely for the second adhesive 23 to contact the lead terminals 14, so that it is possible to further increase the effect of preventing corrosion of the lead terminals 14.

In the first embodiment, the electric wiring substrate 13 is bonded to the supporting member 15 by using the first adhesive 22 and the second adhesive 23. However, the present invention is not limited to such adhesives. The electric wiring substrate 13 may be bonded to the supporting member 15 by using two or more types of adhesives including at least the above-described adhesives.

Second Embodiment

Next, a liquid discharging head according to a second embodiment is described. The liquid discharging head according to the second embodiment differs from the liquid discharging head 1 according to the first embodiment in the form of a supporting member 25. The differences of the second embodiment from the first embodiment are hereunder mainly described, and the members and portions that correspond to those according to the first embodiment are given the same reference numerals, and a detailed description thereof is not given below.

Figure 4:
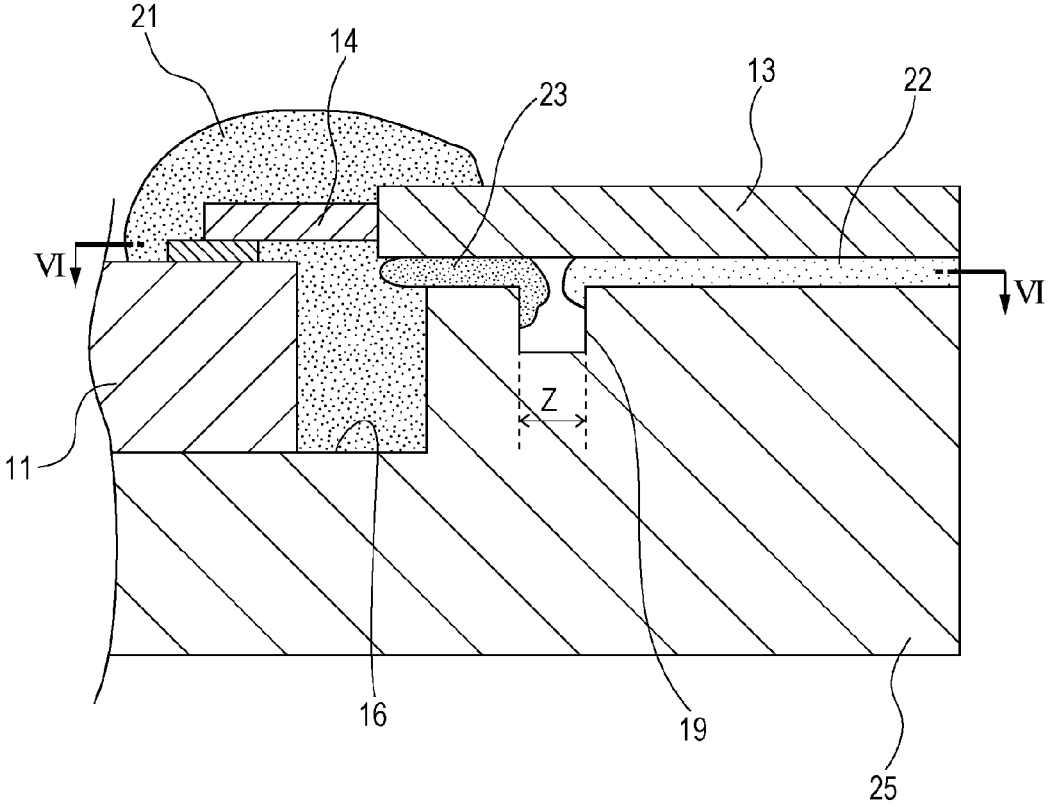
FIG. 4 is a sectional view of a liquid discharging head according to a second embodiment of the present invention.
Figure 5:
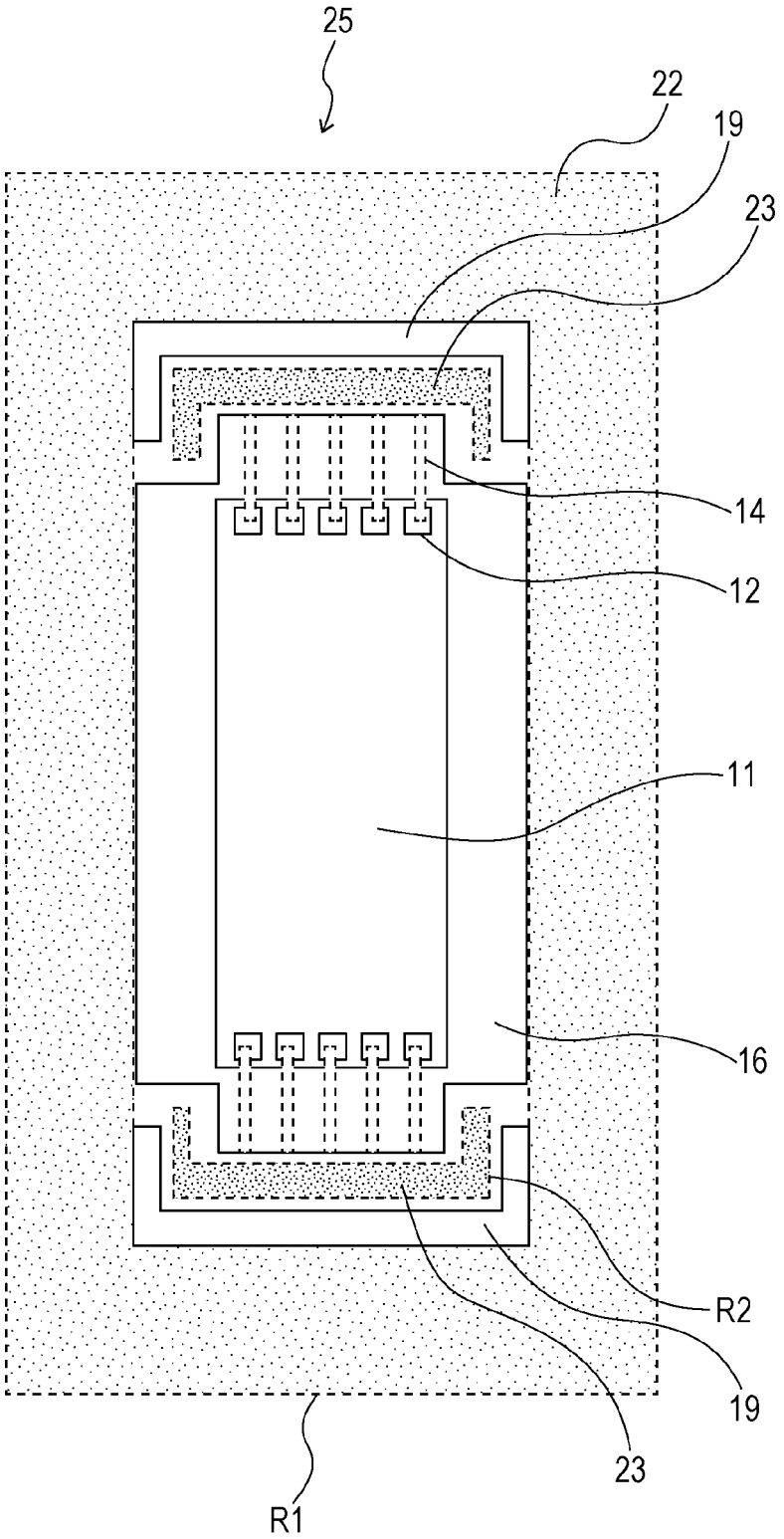
FIG. 5 is a sectional view taken along line V-V in FIG. 4.

FIG. 4 is a sectional view of the liquid discharging head according to the second embodiment of the present invention. Similarly to FIG. 2, FIG. 4 is a sectional view of the vicinity of lead terminals 14. FIG. 5 is a sectional view of the vicinity of a recording element substrate 11 taken along line V-V in FIG. 4.

A recessed portion 19 is formed in the supporting member 25 according to the second embodiment at a portion between a first application region R1 to which a first adhesive 22 is applied and a second application region R2 to which a second adhesive 23 is applied. The recessed portion 19 does not allow the first adhesive and the second adhesive 23 to mix with each other. In the second embodiment, in order to prevent the first adhesive 22 and the second adhesive 23 from mixing with each other even if the first adhesive 22 and the second adhesive 23 protrude from their corresponding application regions when an electric wiring substrate 13 has been pushed against the supporting member 25, a width Z (see FIG. 4) of the recessed portion 19 is approximately 0.3 mm.

The recessed portion 19 is formed in a C shape so as to partly surround the second adhesive 23 applied to the second application region R2. This causes the second application region R2 to be reliably separated from the first application region R1, so that it is possible to increase the effect of preventing the first adhesive 22 from flowing towards the lead terminals 14.

As described above, according to the liquid discharging head of the second embodiment, as with the first embodiment, firm bonding between the electric wiring substrate 13 and the supporting member 15 is ensured by the first adhesive 22 whose bond strength is higher than that of the second adhesive 23. The second adhesive 23 can prevent contact between the first adhesive 22 and the lead terminals 14. In particular, the recessed portion 19 is formed in the supporting member 25 according to the second embodiment so as to separate the second application region R2 from the first application region R1. This makes it even less likely for the first adhesive 22 to enter the second application region R2. Therefore, it is possible to further increase the effect of preventing contact between the first adhesive 22 and the lead terminals 14.

Even in the second embodiment, as with the first embodiment, although the electric wiring substrate 13 is bonded to the supporting member 15 with the first adhesive and the second adhesive 23, the electric wiring substrate 13 may be bonded to the supporting member 15 by using two or more types of adhesives including at least the above-described adhesives.

In each of the above-described embodiments, the electric wiring substrate 13 is described as being one in which the lead terminals 14 and wires in the electric wiring substrate 13 are integrated with each other by what is called tape automated bonding (TAB). However, the present invention is not limited thereto. The present invention is applicable to, for example, a case in which the electric wiring substrate 13 and the recording element substrate 11 are electrically connected to each other with a different wiring member (wires) and an electric connecting portion is formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112185, filed May 30, 2014, which is hereby incorporated by reference herein in its entirety.

What is claimed is:

1. A liquid discharging head comprising:

a recording element substrate configured to discharge a liquid;

an electric wiring substrate that is provided with a lead terminal that is connected to the recording element substrate; and a supporting member having a supporting surface to which the electric wiring substrate is bonded, wherein the electric wiring substrate is bonded to the supporting surface with two or more types of adhesives including at least a first adhesive and a second adhesive whose volume resistivity is higher than that of the first adhesive, a bond strength of the first adhesive is higher than a bond strength of the second adhesive, and, at the supporting surface, the second adhesive is applied such that the second adhesive is provided closer to the lead terminal than the first adhesive.

2. The liquid discharging head according to claim 1, wherein the electric wiring substrate is provided with a plurality of the lead terminals, a portion of the second adhesive is applied along a direction in which the plurality of lead terminals is arranged, and the other portion of the second adhesive is applied along a direction in which the lead terminals extend.

3. The liquid discharging head according to claim 1, wherein the supporting surface includes a recessed portion between a first application region to which the first adhesive is applied and a second application region to which the second adhesive is applied.

4. The liquid discharging head according to claim 3, wherein the electric wiring substrate is provided with a plurality of the lead terminals, and the recessed portion has a portion extending along a direction in which the plurality of lead terminals are arranged and a portion extending along a direction in which the lead terminals extends.

5. The liquid discharging head according to claim 3, wherein an area of the first application region is larger than an area of the second application region.

6. The liquid discharging head according to claim 1, wherein a viscosity of the second adhesive is higher than a viscosity of the first adhesive.

7. The liquid discharging head according to claim 1, wherein the first adhesive is a photo-curable adhesive and the second adhesive is a thermosetting adhesive.

8. The liquid discharging head according to claim 1, wherein a portion of the second adhesive overflows towards the lead terminal from between the electric wiring substrate and the supporting surface.

9. The liquid discharge head according to claim 1, wherein the lead terminal protrudes from an edge of the electric wiring substrate and the edge of the electric wiring substrate is provided at a position closer to a side of the recording element substrate than an end portion of the supporting surface.

10. The liquid discharge head according to claim 1, wherein the lead terminal does not contact the first adhesive.

11. The liquid discharge head according to claim 1, wherein the lead terminal does not contact the second adhesive.

12. The liquid discharging head according to claim 1, wherein the supporting surface includes a recessed portion in which the recording element substrate is arranged, and a distance between an edge of the electric wiring substrate and an edge of the recording element substrate is less than a distance between an inner wall of the recessed portion and the edge of the recoding element substrate.

13. The liquid discharging head according to claim 1, wherein an area of a first application region to which the first adhesive is applied is larger than an area of a second application region to which the second adhesive is applied.

14. A method for producing a liquid discharging head including a recording element substrate configured to discharge a liquid, an electric wiring substrate that is provided with a lead terminal that is connected to the recording element substrate, and a supporting member having a supporting surface to which the electric wiring substrate is bonded, the method comprising the steps of:

applying two or more types of adhesives including at least a first adhesive and a second adhesive whose volume resistivity is higher than that of the first adhesive, and bonding the electric wiring substrate to the supporting surface with the two or more types of adhesives, wherein, in the applying step, after the first adhesive whose bond strength is higher than that of the second adhesive has been applied to the supporting surface, at the supporting member surface, the second adhesive is applied such that the second adhesive is provided closer to the lead terminal than the first adhesive.

15. The method according to claim 14, wherein the electric wiring substrate is provided with a plurality of the lead terminals, in the applying step, a portion of the second adhesive is applied along a direction in which the plurality of lead terminals is arranged, and the other portion of the second adhesive is applied along a direction in which the lead terminals extends.

16. The method according to claim 14, wherein the lead terminal protrudes from an edge of the electric wiring substrate, and in the bonding step, the edge of the electric wiring substrate is provided at a position closer to a side of the recording element substrate than an end portion of the supporting surface.

17. The method according to claim 14, wherein the bonding step is performed after the applying step.

* * * * *